US010818411B2

(12) United States Patent
Wakamatsu et al.

(10) Patent No.: US 10,818,411 B2
(45) Date of Patent: Oct. 27, 2020

(54) WIRE CONDUCTOR, INSULATED WIRE, AND WIRING HARNESS, AND METHOD FOR MANUFACTURING WIRE CONDUCTOR

(71) Applicant: SUMITOMO WIRING SYSTEMS, LTD., Yokkaichi-shi, Mie (JP)

(72) Inventors: Takanori Wakamatsu, Yokkaichi (JP); Jun Yoshimoto, Yokkaichi (JP)

(73) Assignee: SUMITOMO WIRING SYSTEMS, LIMITED, Mie (JP)

( * ) Notice: Subject to any disclaimer, the term of this patent is extended or adjusted under 35 U.S.C. 154(b) by 0 days.

(21) Appl. No.: 16/486,855

(22) PCT Filed: Sep. 1, 2017

(86) PCT No.: PCT/JP2017/031525

§ 371 (c)(1),
(2) Date: Aug. 19, 2019

(87) PCT Pub. No.: WO2018/163465

PCT Pub. Date: Sep. 13, 2018

(65) Prior Publication Data

US 2020/0043630 A1 Feb. 6, 2020

(30) Foreign Application Priority Data

Mar. 9, 2017 (WO) ..... PCT/JP2017/009579

(51) Int. Cl.
*H01B 5/08* (2006.01)
*H01B 7/00* (2006.01)
(Continued)

(52) U.S. Cl.
CPC ..... *H01B 5/08* (2013.01); *H01B 7/0009* (2013.01); *H01B 13/0285* (2013.01); *H01B 1/023* (2013.01)

(58) Field of Classification Search
CPC ..... H01B 5/08
(Continued)

(56) References Cited

U.S. PATENT DOCUMENTS 3,698,963 A * 10/1972 Nunes et al. ..... C21D 8/005 428/685
5,449,861 A * 9/1995 Fujino ..... H01B 13/0006 174/113 A
(Continued)

FOREIGN PATENT DOCUMENTS

JP 2009-140661 A 6/2009
JP 2014-60061 A 4/2014
(Continued)

OTHER PUBLICATIONS

Oct. 3, 2017 International Search Report issued in International Patent Application No. PCT/JP2017/031525.
(Continued)

*Primary Examiner* — Chau N Nguyen
(74) *Attorney, Agent, or Firm* — Oliff PLC

(57) ABSTRACT

A wire conductor has a plurality of elemental wires made of aluminum or an aluminum alloy, which are stranded with each other and arranged, in cross-section intersecting an axial direction of the wire conductor, in which one or a plurality of virtual elemental wires are removed from an outer peripheral portion of a virtual cross-section represented by a maximum number of virtual elemental wires accommodated in a circumscribing figure approximated by a regular hexagon, the virtual elemental wires having a same diameter as the elemental wires. The wire conductor includes a plurality of slave strands, each being a strand of the plurality of elemental wires, a maximum diameter cross-sectional area ratio is 0.63 or higher that is calculated by dividing a cross-sectional area of the wire conductor by an area of a circle having a diameter equal to a maximum value of an outer diameter of the wire conductor.

16 Claims, 5 Drawing Sheets

(51) Int. Cl.
*H01B 13/02* (2006.01)
*H01B 1/02* (2006.01)

(58) Field of Classification Search
USPC ..... 174/128.1, 128.2
See application file for complete search history.

(56) References Cited

U.S. PATENT DOCUMENTS

| | | | | |
|---|---|---|---|---|
| 2003/0141101 | A1* | 7/2003 | Mima | H01B 5/12 174/128.1 |
| 2005/0006135 | A1* | 1/2005 | Nakayama | H01B 7/2806 174/128.1 |
| 2015/0213913 | A1 | 7/2015 | Yoshida et al. | |

FOREIGN PATENT DOCUMENTS

| | | | |
|---|---|---|---|
| JP | 5607853 | B1 | 10/2014 |
| JP | 2015-196881 | A | 11/2015 |

OTHER PUBLICATIONS

Jun. 9, 2020 Office Action issued in Japanese Patent Application No. 2019-504301.
Jul. 30, 2020 Office Action issued in Chinese Application No. 201780087289.7.

* cited by examiner

Example 1
(Concentrically stranded structure)

Comparative Example 1
(Assembly stranded structure)

Example 2
(Annealed-state stranded structure)

Comparative Example 2
(Hard-state stranded structure)

Example 3
(Annealed-state stranded structure)

Comparative Example 3
(Hard-state stranded structure)

WIRE CONDUCTOR, INSULATED WIRE, AND WIRING HARNESS, AND METHOD FOR MANUFACTURING WIRE CONDUCTOR

TECHNICAL FIELD

The present invention relates to a wire conductor, an insulated wire, and a wiring harness, and a method for manufacturing the wire conductor, and more particularly, a wire conductor having a plurality of elemental wires made of aluminum or an aluminum alloy and stranded with each other, an insulated wire and a wiring harness including the wire conductor, and a method for manufacturing the wire conductor.

BACKGROUND ART

Conventionally, copper or a copper alloy has been generally used as a wire conductor of an automotive electric wire. However, an aluminum alloy wire has recently been proposed to use as a wire conductor of an electric wire such as an automotive electric wire, for example, as shown in Patent Document 1. Aluminum has a smaller specific gravity than copper, and using aluminum as materials for conductors of automotive wires can reduce the weights of vehicles, which in turn contributes to lower fuel consumption.

CITATION LIST

Patent Literature

Patent Document 1: Japanese Patent No. 5607853

SUMMARY OF INVENTION

Problems to be Solved by the Invention

In using aluminum or an aluminum alloy instead of copper or a copper alloy for an automotive electric wire as described above, there arises a problem in that the electrical conductivity of aluminum or an aluminum alloy is smaller than that of copper or a copper alloy. Thus, in order to secure a required electrical conductivity in a wire conductor made of aluminum or an aluminum alloy, the conductor cross-sectional area of the wire conductor needs to be larger than that of the wire conductor made of copper or a copper alloy. Therefore, the wire conductor, and an insulated wire including the wire conductor and an insulation cover provided on the outer peripheral surface of the wire conductor increase in outer diameter.

When the wire conductor and the insulated wire increase in outer diameter, a variety of disadvantages can be caused. For example, there arises a problem in that when a terminal is connected to the end of the insulated wire to be housed in a connector housing, it is difficult to insert the end of the insulated wire and the terminal into the connector housing. As shown in FIG. 6A, when a wire conductor 8*a* made of copper or a copper alloy is used, the wire conductor 8*a* is thin, and a terminal 8*b* that fits the wire conductor 8*a* is also small in dimension (height and width), which allows the end of an electric wire 8 and the terminal 8*b* to be inserted into a cavity 91 of a connector housing 90 with ease. Meanwhile, as shown in FIG. 6B, when a wire conductor 9*a* made of aluminum or an aluminum alloy is used with the connector housing 90 same as above, the end of an electric wire 9 and a terminal 9*b* cannot be inserted into the cavity 91 of the connector housing 90 because of the enlarged-diameter electric wire 9 and the resulting enlarged-diameter terminal 9*b*. Considering this circumstance, a wire conductor made of aluminum or an aluminum alloy has been desired, which is reduced in diameter compared with a conventional wire conductor.

An object of the present invention is to provide a wire conductor made of aluminum or an aluminum alloy, which secures a required conductor cross-sectional area while its outer diameter is suppressed small, and an insulated wire and a wiring harness including the wire conductor. In addition, another object of the present invention is to provide a method for manufacturing the wire conductor.

Means of Solving the Problems

In order to solve the above problems, a first wire conductor according to the present invention has a plurality of elemental wires made of aluminum or an aluminum alloy and has a same diameter, the elemental wires stranded with each other, all of the elemental wires in the conductor concentrically stranded as a whole, the elemental wires have an arrangement, in cross-section intersecting an axial direction of the wire conductor, in which one or a plurality of virtual elemental wires are removed from an outer peripheral portion of a virtual cross-section represented by a maximum number of virtual elemental wires accommodated in a circumscribing figure approximated by a regular hexagon, the virtual elemental wires having a same diameter as the elemental wires.

In addition, a second wire conductor according to the present invention has a plurality of elemental wires made of aluminum or an aluminum alloy and has a same diameter, the elemental wires stranded with each other, all of the elemental wires in the conductor concentrically stranded as a whole, the number of the elemental wires constituting the wire conductor being a natural number of four or more, except for $3n(n+1)+1$ (where n is a natural number of one or more).

It is preferable that in the above-described first wire conductor or second wire conductor, a maximum diameter cross-sectional area ratio should be 0.62 or higher, the maximum diameter cross-sectional area ratio being a value calculated by dividing a conductor cross-sectional area of the wire conductor by an area of a circle having a diameter equal to a maximum value of an outer diameter of the wire conductor. It is more preferable that the maximum diameter cross-sectional area ratio should be 0.66 or higher. In addition, it is preferable that an average diameter cross-sectional area ratio should be 0.73 or higher, the average diameter cross-sectional area ratio being a value calculated by dividing a conductor cross-sectional area of the wire conductor by an area of a circle having a diameter equal to an average value of an outer diameter of the wire conductor. It is more preferable that the average diameter cross-sectional area ratio should be 0.76 or higher. In addition, it is preferable that when the outer diameter of each of the elemental wires is 0.32 mm and a nominal cross-sectional area of the wire conductor is 5 sq, a maximum value of the outer diameter of the wire conductor should be smaller than 3.10 mm or an average value of the outer diameter of the wire conductor should be smaller than 2.85 mm.

A third wire conductor according to the present invention has a plurality of elemental wires made of aluminum or an aluminum alloy, the elemental wires stranded with each other, the wire conductor has a plurality of slave strands, each of the slave strands being a strand of a plurality of elemental wires, wherein a maximum diameter cross-sectional area ratio is 0.63 or higher, the maximum diameter cross-sectional area ratio being a value calculated by dividing a conductor cross-sectional area of the wire conductor by an area of a circle having a diameter equal to a maximum value of an outer diameter of the wire conductor.

It is preferable that in the above-described third wire conductor, an average diameter cross-sectional area ratio should be 0.71 or higher, the average diameter cross-sectional area ratio being a value calculated by dividing a conductor cross-sectional area of the wire conductor by an area of a circle having a diameter equal to an average value of an outer diameter of the wire conductor. It is more preferable that when the outer diameter of each of the elemental wires is 0.32 mm and a nominal cross-sectional area of the wire conductor is 10 sq, a maximum value of the outer diameter of the wire conductor should be smaller than 4.6 mm or an average value of the outer diameter of the wire conductor should be smaller than 4.3 mm. In addition, it is preferable that when the outer diameter of each of the elemental wires is 0.32 mm and a nominal cross-sectional area of the wire conductor is 20 sq, a maximum value of the outer diameter of the wire conductor should be smaller than 6.5 mm or an average value of the outer diameter of the wire conductor should be smaller than 6.0 mm.

An insulated wire according to the present invention includes any of the above-described wire conductors and an insulation cover covering an outer peripheral surface of the wire conductor.

A wiring harness according to the present invention includes the above-described insulated wire.

A method for manufacturing the wire conductor according to the present invention includes the steps of subjecting the elemental wires to an annealing treatment, preparing each of the slave strands by stranding the plurality of elemental wires, and stranding the plurality of slave strands, the steps being carried out in this order.

Advantageous Effects of Invention

In the first wire conductor according to the above-described invention, since all the elemental wires in the conductor are concentrically stranded as a whole, the elemental wires can be disposed closely to one another, and also the stranded structure is not easily destroyed. As a result thereof, the outer diameter of the wire conductor can be suppressed small while a required conductor cross-sectional area can be secured. When the arrangement of the elemental wires cannot be achieved in cross-section represented by the maximum number of elemental wires accommodated in a circumscribing figure approximated by a regular hexagon like the virtual cross-section described above, an assembly stranded structure has generally been adopted conventionally. However, even when such an arrangement of the elemental wire providing a circumscribing figure approximated by a regular hexagon cannot be achieved in cross-section, achieving, instead of an assembly stranded structure, the arrangement of the elemental wires in which one or a plurality of virtual elemental wires is removed from an outer peripheral portion of the virtual cross-section allows the elemental wires to be stranded closely to one another, and thus the effect of suppressing the outer diameter of the wire conductor small can be obtained.

Also in the second wire conductor according to the above-described invention, since all of the elemental wires in the conductor concentrically stranded as a whole, the elemental wires can be disposed closely to one another, and also the stranded structure is not easily destroyed. As a result thereof, the outer diameter of the wire conductor can be suppressed small while a required conductor cross-sectional area can be secured. When the number of the elemental wires is other than $3n(n+1)+1$, the arrangement of the elemental wires providing a circumscribing figure approximated by a regular hexagon cannot be achieved even if the elemental wires are most closely stranded to have a concentrically stranded structure; however, even in such a case, stranding the elemental wires to have a concentrically stranded structure allows the elemental wires to be stranded closely to one another, and thus the effect of suppressing the outer diameter of the wire conductor small can be obtained.

Here, in the above-described first wire conductor and second wire conductor, when the maximum diameter cross-sectional area ratio is 0.62 or higher, or 0.66 or higher, the maximum diameter cross-sectional area ratio being a value calculated by dividing a conductor cross-sectional area of the wire conductor by an area of a circle having a diameter equal to a maximum value of an outer diameter of the wire conductor, and when the average diameter cross-sectional area ratio is 0.73 or higher, or 0.76 or higher, the average diameter cross-sectional area ratio being a value calculated by dividing a conductor cross-sectional area of the wire conductor by an area of a circle having a diameter equal to an average value of an outer diameter of the wire conductor, the outer diameter of the wire conductor can be suppressed smaller while a required conductor cross-sectional area can be secured better compared with conventional wire conductors. This is because since each of the maximum diameter cross-sectional area ratio and the average diameter cross-sectional area ratio represents an area of the elemental wires occupied by a circle having a diameter equal to the outer diameter of the wire conductor diameter, the values of the conductor cross-sectional area ratios become higher as the outer diameter of the wire conductor is smaller when the conductor cross-sectional area does not change.

The third wire conductor according to the above-described invention includes a plurality of slave strands, each of the slave strands being a strand of the plurality of elemental wires. In general, gaps are likely to be formed among the slave strands in a wire conductor having this kind of stranded structure; however, by setting the maximum diameter cross-sectional area ratio to 0.63 or higher, the ratio representing the area of the elemental wires accounting for a circle having a diameter equal to a maximum value of the outer diameter of the wire conductor, those gaps are narrowed. As a result thereof, the outer diameter of the wire conductor can be suppressed small while a required conductor cross-sectional area can be secured.

Here, in the above-described third wire conductor, when the average diameter cross-sectional area ratio is 0.71 or higher, the average diameter cross-sectional area ratio being a value calculated by dividing a conductor cross-sectional area of the wire conductor by an area of a circle having a diameter equal to an average value of an outer diameter of the wire conductor, the average diameter cross-sectional area ratio in addition to the above-described maximum diameter cross-sectional area ratio can be used as indicators, and thus the outer diameter of the wire conductor can be suppressed small while a required conductor cross-sectional area can be secured.

Since the insulated wire according to the above-described invention includes the reduced diameter wire conductor, the entire insulated wire has a small outer diameter. In addition, when the wire conductor is sufficiently reduced in diameter, the outer diameter of the entire insulated wire can be maintained small even if an insulation cover is made thick to some extent.

The wiring harness according to the above-described invention can be configured with the use of the diameter reduction effect in the insulated wire.

In manufacturing the above-described third wire conductor, according to the method for manufacturing the wire conductor according to any of the above-described inventions, the annealing treatment can improve the elongation of the elemental wires, whereby the elemental wires, when stranded later, can be flexibly deformed with ease, and thus the plurality of elemental wires can be stranded while disposed closely to one another. In particular, gaps formed among the slave strands can be narrowed with ease. As a result thereof, the outer diameter of the wire conductor can be suppressed small while a required conductor cross-sectional area can be secured.

BRIEF DESCRIPTION OF DRAWINGS

FIG. 4 are views of arrangements of the elemental wire in assembly stranded structures, where

FIG. 6 are side views for illustrating the states of inserting insulated wires with terminals into connector housings, where

DESCRIPTION OF EMBODIMENTS

Next, detailed descriptions of embodiments of the present invention will be provided.

[First Wire Conductor and Insulated Wire]

Figure 1:
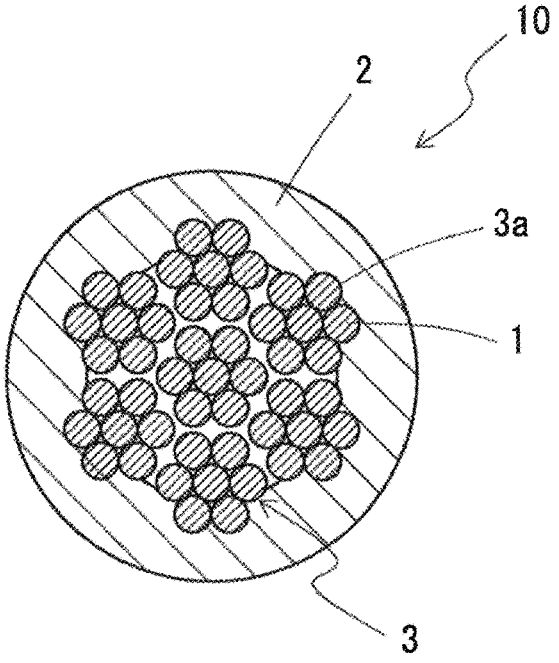
FIG. 1 is a cross-sectional view of an insulated wire according to the first embodiment of the present invention.
Figure 2:
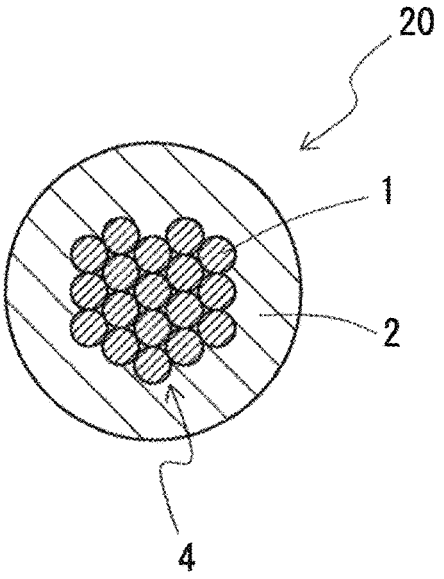
FIG. 2 is a cross-sectional view of an insulated wire according to the second embodiment of the present invention.

First, a description of a wire conductor 3 and an insulated wire 10 according to the first embodiment of the present invention will be provided with reference to FIG. 1. In FIG. 1, and FIG. 2 that is described later, the number of the elemental wires 1 is illustrated smaller than the number in an actual preferred embodiment so as to be easily seen.

The wire conductor 3 according to the first embodiment of the present invention is a plurality of elemental wires 1 made of aluminum or an aluminum alloy, the elemental wires stranded with each other. In the present embodiment, all the entire elemental wires 1 are not stranded as a whole, but the elemental wires 1 are stranded in units of a slave strand 3*a*. To be specific, the wire conductor 3 includes a plurality of slave strands 3*a*, each of which is a strand of a plurality of elemental wires 1.

Here, the maximum diameter cross-sectional area ratio of the wire conductor 3 can be calculated. The maximum diameter cross-sectional area ratio is a value calculated by dividing the conductor cross-sectional area of the wire conductor 3 by the area of a circle having a diameter equal to a maximum value of an outer diameter of the wire conductor 3. To be specific, the maximum diameter cross-sectional area ratio Rm can be calculated by the following equation (1), where S represents the conductor cross-section of the wire conductor 3, and Lm represents the maximum value of the outer diameter of the wire conductor 3.

$$Rm=S/\pi(Lm/2)^2 \quad (1)$$

The conductor cross-sectional area S is the total sum of the cross-sectional areas of the elemental wires 1 constituting the wire conductor 3, and when all the elemental wires 1 are identical to one another, the conductor cross-sectional area S can be calculated as an amount obtained by multiplying the cross-sectional area of one elemental wire 1 by the number of the elemental wires 1. In addition, when the wire conductor 3 does not have an approximately ideal circular cross-section, the resulting value of the outer diameter of the wire conductor 3 in cross-section varies according to the positions and directions in which the outer diameter is measured; however, the maximum value Lm of the outer diameter used for evaluation of the maximum diameter cross-sectional area ratio Rm in the above description represents a maximum value among measurement values of the outer diameters that are measured as straight lines passing through the center of gravity of the cross-section of the wire conductor 3 to intersect the cross-section at different positions on one cross-section, or on a plurality of cross-sections. In addition, the average value of the outer diameter described later represents the average value of those measurement values.

When the wire conductors 3 have the same conductor cross-sectional area, the wire conductors 3 having higher maximum diameter cross-sectional area ratios have smaller maximum values of the outer diameters. The maximum diameter cross-sectional area ratio defines an amount having a positive correlation with the ratio of the area occupied by the metallic material in the cross-section of the wire conductor 3, and as the maximum diameter cross-sectional area ratio is higher, a required number of the elemental wires 1 can be disposed in a smaller space. Thus, in the present embodiment, considering that the wire conductor 3 is reduced in diameter while a required conductor cross-sectional area is secured, the maximum diameter cross-sectional area ratio Rm is controlled to be not lower than a predetermined lower limit value Am as represented by equation (2).

$$Rm \geq Am \quad (2)$$

The specific lower limit value Am of the maximum diameter cross-sectional area ratio Rm is set to 0.63 in the wire conductor 3 according to the present embodiment. The lower limit value Am is preferably set to 0.64, and more preferably to 0.66.

The maximum diameter cross-sectional area ratio Rm is used as an indicator of diameter reduction of the wire conductor 3 in the present description; however, it is also possible to use the maximum value Lm itself of the outer diameter of the wire conductor 3, which is based on the diameter of the elemental wires, as an indicator equivalent to the maximum diameter cross-sectional area ratio Rm. To be specific, the maximum value Lm can be expressed as follows using equation (1) and equation (2), where d represents the outer diameter of each elemental wire 1, and N represents the number of the elemental wires 1 constituting the wire conductor 3.

$$Rm=S/\pi(Lm/2)^2=[N\pi(d/2)^2]/[\pi(Lm/2)^2]=Nd^2Lm^2\geq Am \quad (3),$$

$$\text{whereby } Lm\leq Am^{-0.5}\cdot N^{0.5}\cdot d \quad (4)$$

The kind of the aluminum alloy of which the elemental wires 1 are made is not particularly designated. It is preferable to use aluminum alloys of 1000 series including pure aluminum alloys or aluminum alloys of 3000 series from the viewpoint that the elemental wires 1 can have high elongation and be stranded closely. It is preferable that the elemental wires 1 should have elongation of 10% or more, and more preferable that the elemental wires 1 should have elongation of 15% or more after an annealing treatment.

The insulated wire 10 according to the present embodiment includes the above-described wire conductor 3 and an insulation cover 2 provided on the outer peripheral surface of the wire conductor 3. The material for the insulation cover 2 is not particularly designated; however, examples thereof include a polyvinyl chloride resin (PVC) and an olefin-based resin as a resin material. In addition to the resin material, a filler or an additive may be added appropriately. Further, the resin material may be cross-linked.

The insulated wire 10 according to the present embodiment can be used in the form of a wiring harness composed of a bundle of a plurality of insulated wires. In this case, all of the insulated wires constituting the wiring harness may be composed of the insulated wires 10 according to the present embodiment, or a part of the insulated wires constituting the wiring harness may be composed of the insulated wires 10 according to the present embodiment.

As described above, as the maximum diameter cross-sectional area ratio is higher, a required number of the elemental wires 1 can be disposed in a smaller space, and since the maximum diameter cross-sectional area ratio is set to 0.63 or higher in the wire conductor 3 according to the present embodiment, the outer diameter of the wire conductor 3 can be made small while a conductor cross-sectional area required from the viewpoints of electrical conductivity and the like can be secured.

By suppressing the outer diameter of the wire conductor 3 small, the outer diameter of the entire insulated wire 10 can be suppressed small. Alternatively, in a case where the upper limit value of the outer diameter of the insulated wire 10 is predetermined, the insulation cover 2 can be increased in thickness while the outer diameter of the entire insulated wire 10 is confined within the range. By doing so, characteristic features that the insulation cover 2 has such as insulating characteristics, mechanical characteristics, protection performance to the wire conductor 3 can be used sufficiently. For example, an insulated wire 10 can be configured, which has an outer diameter close to that of an insulated wire having the same electric resistance value and including a conductor made of copper or a copper alloy, while including an insulation cover securing a realistic thickness. In addition, when the insulation cover 2 is increased in thickness, variation in thickness can be reduced, the process capability index (Cpk) in forming the insulation cover 2 rises. As a result thereof, variation in the outer diameter of the entire insulated wire 10 can be suppressed small.

In measuring, when the wire conductor 3 does not have an approximately ideal circular cross-section, the outer diameter of the wire conductor 3 as straight lines passing through the center of gravity of the cross-section of the wire conductor 3 to intersect the cross-section as described above, the greatest diameter reduction effect is exerted in the maximum value among the measurement values of the outer diameter. In contrast, the smallest diameter reduction effect is exerted in the minimum value among them. The effect in the average value is between the effect in the maximum value and the effect in the minimum value. This is because when the elemental wires 1 and slave strands 3*a* are arranged very closely, and the wire conductor 3 is reduced in outer diameter, the dimensional reduction due to the very close arrangement becomes more pronounced at a section with a larger dimension. From this point of view, using a maximum diameter cross-sectional area ratio that is not based on the average value or the minimum value of the outer diameter of the wire conductor 3 but is based on the maximum value as an indicator of diameter reduction of the wire conductor 3 can achieve diameter reduction of the wire conductor 3 especially effectively.

As described above, the maximum diameter cross-sectional area ratio is an indicator suitable for evaluating the ratio of the area occupied by the metallic material of the elemental wires 1 in the cross-section of the wire conductor 3; however, it is also considered to use another amount as an indicator of diameter reduction from the viewpoint of diameter reduction of the insulated wire 10. For example, the average diameter cross-sectional area ratio can be used as an indicator, the ratio being a value calculated by dividing the conductor cross-sectional area of the wire conductor 3 by the area of a circle having a diameter equal, not to the maximum value of the outer diameter of the wire conductor 3, but to the area of a circle having a diameter equal to an average value of the outer diameter of the wire conductor 3. When the wire conductor 3 has a cross-sectional shape largely departing from a circular shape, the maximum diameter cross-sectional area ratio based on the maximum value of the outer diameter of the wire conductor 3 can be used as an especially excellent indicator of diameter reduction as described above; however, the average diameter cross-sectional area ratio based on the average value of the outer diameter of the wire conductor 3 can be also used as a relatively good indicator in diameter reduction of the wire conductor 3. Thus, in addition to the maximum diameter cross-sectional area ratio, or instead of it, the average diameter cross-sectional area ratio may be used. In particular, when the wire conductor 3 has a cross-sectional shape that is not largely departing from a circular shape, the average diameter cross-sectional area ratio can be used as an excellent indicator.

In the wire conductor 3 according to the present embodiment, the average diameter cross-sectional area ratio calculated as described above is preferably 0.71 or higher, more preferably 0.73 or higher, and still more preferably 0.75 or higher.

In addition, a value calculated by dividing a conductor cross-sectional area by the area of a region surrounded by the inner perimeter of the insulation cover 2 (referred to as an inner perimeter conductor ratio) may be used as another indicator so as to be kept larger than a predetermined lower limit value.

The wire conductor 3 according to the present embodiment can be preferably manufactured by first subjecting the elemental wires 1 to an annealing treatment, and then stranding the elemental wires 1 that have been subjected to the annealing treatment (an annealed-state stranding method). To be specific, after subjecting the elemental wires 1 to an annealing treatment, slave strands 3*a* are prepared in the step of stranding a plurality of elemental wires 1 into each slave strand 3*a*, and further the plurality of slave strands 3*a* are stranded into a master strand.

Conditions for the annealing treatment to which the elemental wires 1 are subjected to are appropriately established according to the material for the wire conductor 3 and the like. While the annealing treatment may be a batch-type annealing treatment or a continuous annealing treatment, the batch-type annealing treatment is preferably used from the viewpoint of effectively improving elongation or the like. In addition, the wire conductor 3 may be appropriately subjected to any heat treatment other than an annealing treatment. Examples of the heat treatment include an aging treatment. In this case, the aging treatment may be carried out before or after the elemental wires 1 are stranded.

By subjecting the elemental wires 1 made of aluminum or an aluminum alloy to an annealing treatment, the elemental wires 1 are improved in elongation. Thus, the elemental wires 1 become flexible, and can be deformed with ease, whereby when the elemental wires 1 that have been subjected to an annealing treatment in advance are stranded, the plurality of elemental wires 1 can be disposed closely to one another with ease. As a result thereof, the outer diameter of the wire conductor 3 can be suppressed small while a conductor cross-sectional area required from the viewpoints of electrical conductivity and the like can be secured, whereby the value of the maximum diameter cross-sectional area ratio can be reduced. In addition, variation in the outer diameter of the wire conductor 3 can be suppressed small. Further, the obtained strand may be compression molded in the radial direction, whereby further diameter reduction of the wire conductor 3 can be achieved. However, it is preferable to achieve the above-described maximum diameter cross-sectional area ratio or average diameter cross-sectional area ratio without carrying out compression molding.

Nicks are likely to be made on the surface of the material in the stranding step of stranding the elemental wires 1 made of aluminum or an aluminum alloy, and thus an annealing treatment is, in stranding the elemental wires 1 to constitute the wire conductor 3, conventionally carried out generally after the elemental wires 1 are stranded from the viewpoint of reducing the influence by the nicks. However, if the elemental wires 1 that are yet to be subjected to an annealing treatment are stranded in the stranding step, and then the stranded elemental wires 1 are subjected to an annealing treatment (a hard-state stranding method), the elemental wires 1 with low elongation and poor in flexibility are stranded. In this case, it is difficult to bring the elemental wires 1 sufficiently close to one another and dispose them closely to one another, and thus the resulting outer diameter of the wire conductor 3 is likely to be large. If the hard-state stranding method is used in manufacturing a wire conductor having a slave-stranded structure and a master-stranded structure like the wire conductor 3 according to the present embodiment, the maximum diameter cross-sectional area ratio becomes smaller than 0.63, and further smaller than 0.62 as described later in the examples.

In particular, in a case of a wire conductor 3 including a plurality of stranded slave strands 3*a* like the wire conductor 3 according to the present embodiment, a diameter reduction effect obtained by adopting the annealed-state stranding method, not a hard-state stranding method, is exerted more pronouncedly compared with a case where all of the elemental wires 1 are stranded as a whole (a wholly stranded structure). In general, in the case of a wire conductor 3 including a plurality of stranded slave strands 3*a*, gaps are likely to be formed among the slave strands 3*a*, resulting in the enlarged-diameter wire conductor 3 compared with a wire conductor 3 having a wholly stranded structure. However, carrying out an annealing treatment in advance allows the slave strands 3*a* to have high flexibility to be brought into intimate contact with one another in a flexible manner, whereby the outer diameter of the resulting wire conductor 3 can be suppressed small.

Figure 3A:
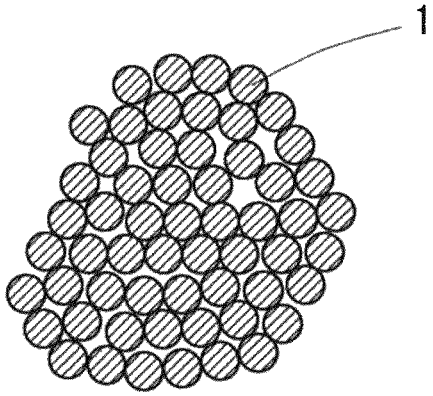
FIG. 3(A) is a cross-sectional view of a wire conductor in which elemental wires are stranded to have an assembly stranded structure.

As for a stranded structure of the elemental wires 1 in each slave strand 3*a*, an assembly stranded structure is possible, in which all of the elemental wires 1 are stranded randomly as a whole in the same direction (see FIG. 3(A)), or a concentrically stranded structure is possible, in which around one or a plurality of elemental wires 1, the other elemental wires 1 are stranded concentrically. The assembly stranded structure is preferable. This is because the slave strands 3*a* having the assembly stranded structure are deformed flat with ease when stranding the slave strands 3*a* into a master strand, and using the deformation allows the slave strands 3*a* to be stranded into a thin wire conductor 3 with ease. In stranding the slave strands 3*a* into a master strand, all of the slave strands 3*a* may be stranded once as a whole, or the slave strands 3*a* may be stranded into a master strand a plurality of times in such a way that a part of the slave strands 3*a* are stranded and the other slave strands 3*a* are disposed around the already-stranded slave strands 3*a* to be stranded again.

The specific dimension of the wire conductor 3 is not particularly designated; however, a wire conductor 3 having a larger conductor outer diameter or a larger number of elemental wires 1 constituting the wire conductor 3 could have more room for being increased in diameter, so that the effect of specifying the maximum diameter cross-sectional area ratio to attain diameter reduction as described above is increased. In fact, the maximum diameter cross-sectional area ratio can be increased with more ease. Basically, the wire conductor 3 adopts, when having a nominal cross-sectional area of 8 sq (a conductor cross-sectional area: 7.882 $mm^2$) or larger stipulated in JASO D603, a slave stranding-master stranded structure, not a wholly stranded structure, and thus it is preferable to adopt the wire conductor 3 according to the present embodiment within the range of a nominal cross-sectional area of 8 sq or larger. The wire conductor 3 according to the present embodiment is preferably adopted within the range of a nominal cross-sectional area of 10 sq (a conductor cross-sectional area: 10.13 $mm^2$) or larger, and still more preferably adopted within the range of a nominal cross-sectional area of 20 sq (a conductor cross-sectional area: 19.86 $mm^2$) or larger.

The outer diameter of each elemental wire 1 to be used is not particularly designated; however, the number of the elemental wires 1 used to obtain a required conductor cross-sectional area increases as the elemental wires 1 have a smaller diameter, and because of choice of the stranded structure or the like, the wire conductor 3 could have room for being increased in diameter. For this reason, as the outer diameter of each elemental wire 1 is smaller, it is more significant to specify the maximum diameter cross-sectional area ratio to attain diameter reduction of the wire conductor 3. In addition, in constituting wire conductors 3 having the same conductor cross-sectional area, the one having thinner elemental wires 1 can provide the wire conductor 3 with higher resistance characteristics against vibration or flex. For example, the elemental wires 1 preferably have an outer diameter of 0.5 mm or smaller, and more preferably 0.32 mm or smaller. In addition, the number of the elemental wires 1 constituting the wire conductor 3 is preferably 100 or more, and more preferably 200 or more.

In the wire conductor 3 according to the present embodiment, as a specific diameter reduction effect, for example, when the elemental wires 1 have an outer diameter of 0.32 mm and a nominal cross-sectional area of 10 sq, the outer diameter of the wire conductor 3 can be made smaller than 4.6 mm and further can be made 4.5 mm or smaller at the maximum. The outer diameter of the wire conductor 3 can be made smaller than 4.3 mm and further can be made 4.2 mm or smaller on average, and can be made smaller than 4.0 mm and further can be made 3.9 mm or smaller at the minimum. In addition, when the outer diameter of the entire insulated wire 10 is made 5.8 mm or smaller at the maximum and 5.7 mm or smaller on average in this case, the insulation cover 2 can have a thickness (on average) of 0.65 mm or larger, and further can have a thickness of 0.75 mm or larger.

Meanwhile, when the elemental wires 1 have an outer diameter of 0.32 mm and a nominal cross-sectional area of 20 sq, the outer diameter of the wire conductor 3 can be made smaller than 6.5 mm and further can be made 6.2 mm or smaller at the maximum. The outer diameter of the wire conductor 3 can be made smaller than 6.0 mm and further can be made 5.8 mm or smaller on average, and can be made smaller than 5.5 mm and further can be made 5.3 mm or smaller at the minimum. In addition, when the outer diameter of the entire insulated wire 10 is made 7.8 mm or smaller at the maximum and 7.6 mm or smaller on average in this case, the insulation cover 2 can have a thickness (on average) of 0.75 mm or larger, and further can have a thickness of 0.80 mm or larger.

In the present embodiment, the wire conductor 3 having a slave stranding-master stranded structure has a maximum diameter cross-sectional area ratio of 0.63 or higher, and the annealed-state stranding method is used as a preferable manufacturing method for achieving this ratio. However, even if having a maximum diameter cross-sectional area ratio other than this ratio, the wire conductor 3 including the elemental wires 1 made of aluminum or an aluminum alloy and having a slave stranding-master stranded structure can have a diameter reduction effect by adopting the annealed-state stranding method, not the hard-state stranding method. For example, while the maximum diameter cross-sectional area ratio is likely to be lower than 0.62 in adopting the hard-state stranding method as described above; however, by adopting the annealed-state stranding method, the wire conductor 3 having a maximum diameter cross-sectional area ratio of 0.62 or higher can be obtained.

[Second Wire Conductor and Insulated Wire]

Next, a description of a wire conductor 4 and an insulated wire 20 according to the second embodiment of the present invention will be provided. Here, configurations different from those of the above-described first embodiment will be explained mainly while descriptions of configurations similar to those of the first embodiment are omitted.

FIG. 2 is a cross-sectional view of the wire conductor 4 and the insulated wire 20 according to the second embodiment of the present invention. The wire conductor 4 is a plurality of elemental wires 1 made of aluminum or an aluminum alloy, the elemental wires stranded with each other. Each of the plurality of elemental wires 1 has the same outer diameter within the range of manufacture tolerance (for example, within the range of ±10%).

Figure 3B:
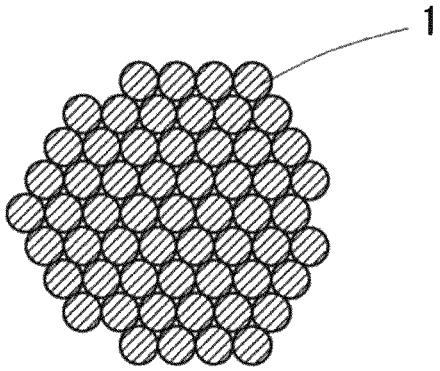
FIG. 3(B) is a cross-sectional view of a wire conductor in which elemental wires are stranded to have a concentrically stranded structure.

The wire conductor 4 according to the present embodiment is a plurality of the elemental wires 1, the elemental wires stranded with each other, all of which in the conductor are concentrically stranded as a whole. As described above, in the concentrically stranded structure, around one or a plurality of elemental wires 1, the other elemental wires 1 are stranded concentrically. The present embodiment is mainly on the assumption that the number of the center elemental wires 1 would be one in accordance with the small conductor cross-sectional area. As shown in the cross-sections in FIG. 2, FIG. 3(B), and FIG. 4, the elemental wires 1 are disposed closely in the wire conductor in which the elemental wires 1 are concentrically stranded as a whole. Each of the elemental wires 1 other than the elemental wires 1 disposed in the outer peripheral portion of the wire conductor is disposed to define a corner of an approximated regular triangle, surrounded by other six elemental wires 1, and in contact with those other six elemental wires 1 (closest filling).

Figure 4A:
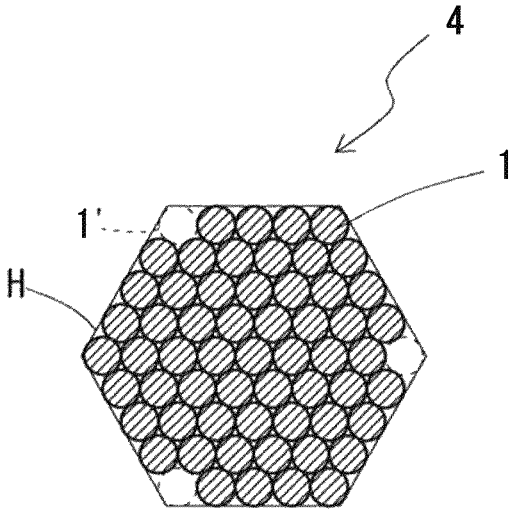
FIG. 4(A) is a view in the case of a non-hexagon arrangement.
Figure 4B:
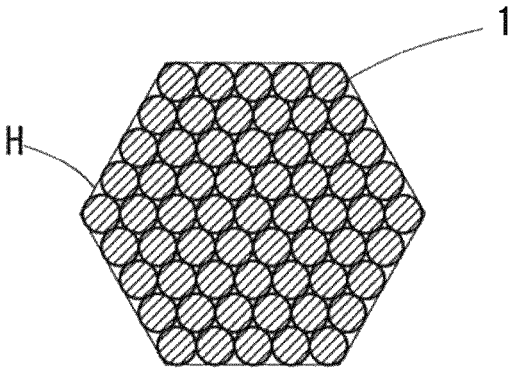
FIG. 4(B) is a view in the case of a hexagon arrangement.
Figure 5A:
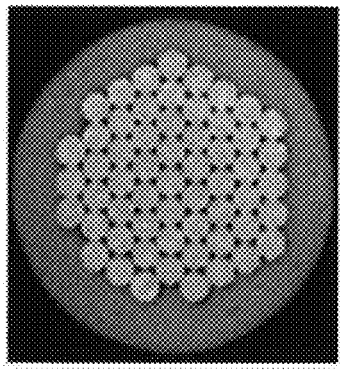
FIG. 5 are cross-sectional photographs of insulated wires according to examples and comparative examples.
Figure 5B:
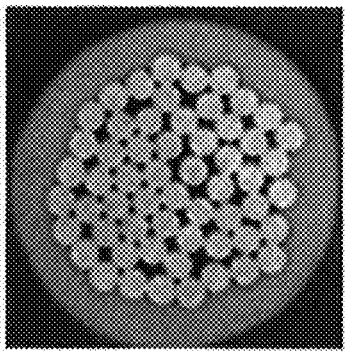
Figure 5C:
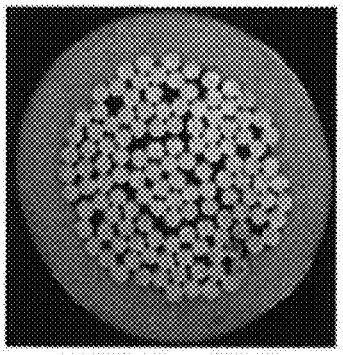
Figure 5D:
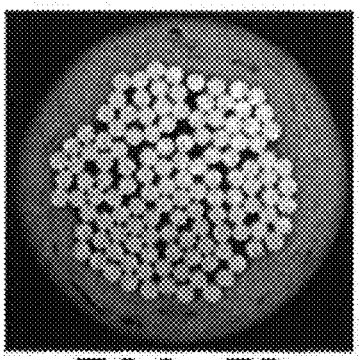
Figure 5E:
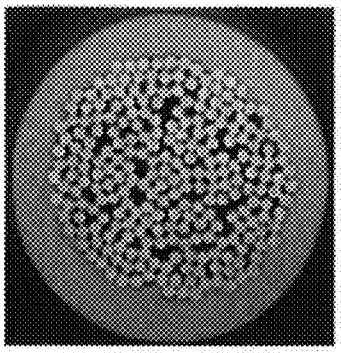
Figure 5F:
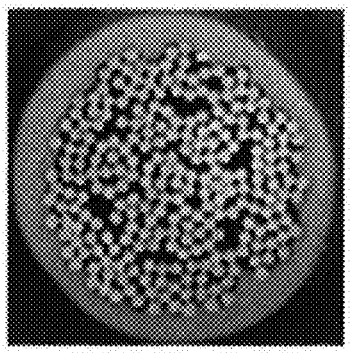
Figure 6A:
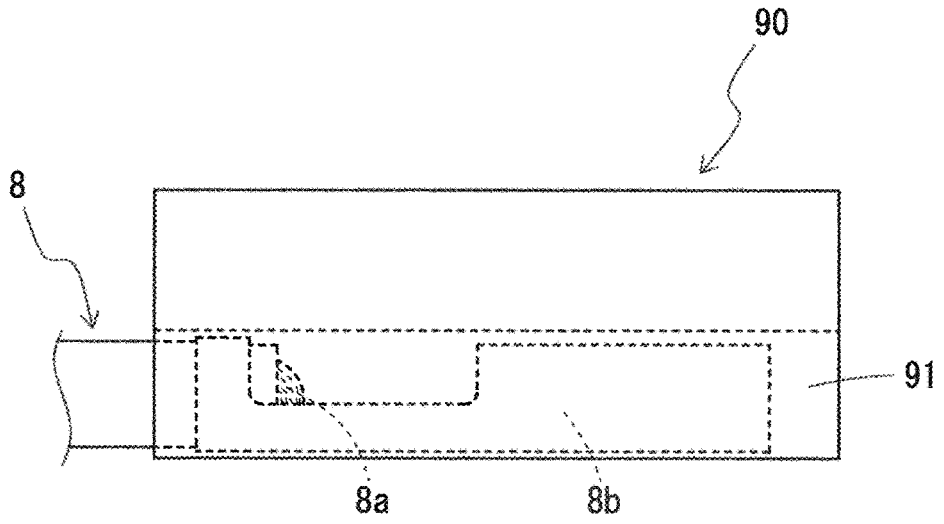
FIG. 6(A) is a view in the case of a conventional general copper wire.
Figure 6B:
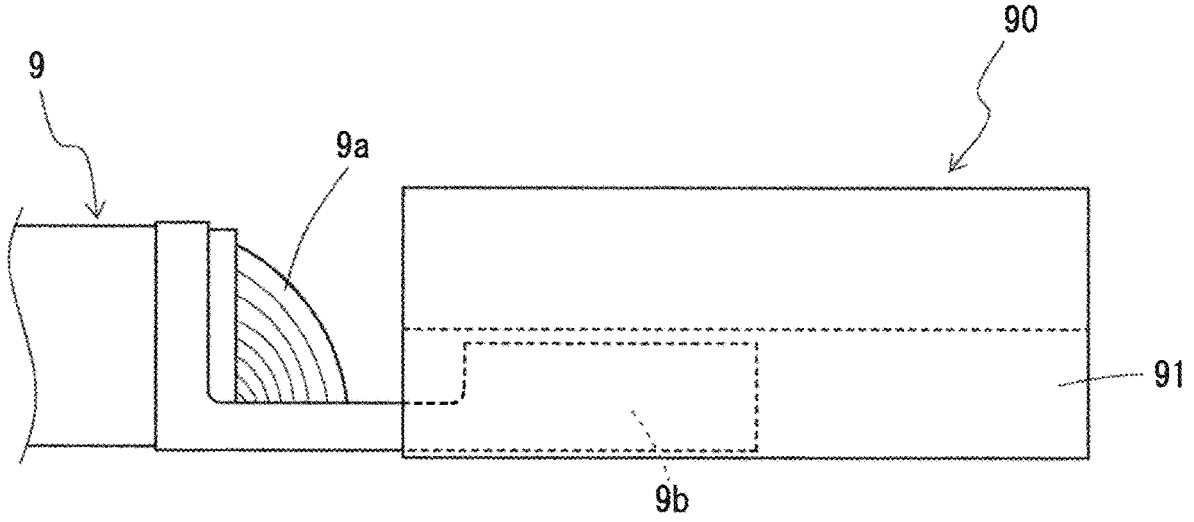
FIG. 6(B) is a view in the case of a conventional general aluminum wire.

In stranding the plurality of elemental wires to have a concentrically stranded structure, there is a possibility that the elemental wires 1 can have an arrangement in which a circumscribing figure H approximated by a regular hexagon is accommodated in the maximum number of the elemental wires 1 (hexagon arrangement) in cross-section intersecting the axial direction of the wire conductor as shown in FIG. 4(B), that is, there is a possibility that an arrangement of the elemental wire obtained by the above-described closest filling can be approximated by a circumscribing figure H of a regular hexagon. However, the number N of the elemental wires 1 that allows such a hexagon arrangement is limited to the cases represented by the following equation (5), where n is a natural number of one or more.

[Mathematical 1]

$$N = 1 + \sum_{k=1}^{n} 6k = 3n(n+1) + 1 \tag{5}$$

In other words, those possibilities exist only if N=7, 19, 37, 61 . . . .

On the other hand, the wire conductor 4 according to the present embodiment includes, when the elemental wires 1 cannot have the above-described hexagon arrangement, the elemental wires 1 stranded with each other, all of which in the conductor are concentrically stranded as a whole. In this case, the cross-section intersecting the axial direction of the wire conductor 4 is such that one or a plurality of virtual elemental wires 1' are removed from an outer peripheral portion of a virtual cross-section that is a circumscribing figure H approximated by a regular hexagon accommodated in a maximum number of the virtual elemental wires 1' as shown in FIG. 4(A). The virtual elemental wires 1' define virtual elemental wires that are same in diameter as the elemental wires 1 constituting the wire conductor 4, and the virtual cross-section defines a cross-section having a hexagon arrangement configured using the virtual elemental wires 1'. A part of the virtual elemental wires 1' is removed from the outer peripheral portion of the virtual cross-section, that is, from the plurality of virtual elemental wires 1' constituting the outer circumference edge of the hexagon arrangement. The positions where the virtual elemental wires 1' are not removed are accommodated in the actual elemental wires 1. While shown in FIG. 4(A) is an arrangement of the elemental wire same as that shown in FIG. 3(B), the virtual elemental wires 1' removed from the virtual cross-section are indicated by the dotted lines, and the actual elemental wires 1 charged at the positions where the virtual elemental wires 1' are not removed are indicated by the solid lines. The resulting cross-section of the wire conductor 4 has an outer shape of a regular hexagon a part of which is chipped in circular arc shape. The concepts of "virtual elemental wires", a "virtual cross-section", and "removing" in the present description are used for the sake of illustration in explaining the arrangement of the elemental wires 1 in the wire conductor 4 in cross-section, which does not mean that in the actual manufacturing of the wire conductor 4, a wire conductor having a hexagon arrangement in cross-section like a virtual cross-section is manufactured, and a part of elemental wires is removed from the outer peripheral portion of the wire conductor.

The positions and the number of the virtual elemental wires 1' to be removed can be freely set as long as the number of the virtual elemental wires 1' removed from the outer peripheral portion of the virtual cross-section is one or more and less than the number of the virtual elemental wires 1' constituting the outer peripheral edge of the virtual cross-section (24 virtual elemental wires 1' in FIG. 4(A)). From the viewpoints of the greatest reduction in the maximum value of the outer diameter of the wire conductor 4 and stabilization of stranding of the elemental wires 1, it is preferable that the virtual elemental wires 1' at the positions corresponding to the corners of the circumscribing figure H should be removed prior to the virtual elemental wires 1' at the positions corresponding to some midway portions of the sides of the circumscribing figure H as shown in FIG. 4(A). In addition, it is preferable that in the case of removing a plurality of virtual elemental wires 1', virtual elemental wires 1' adjacent to one another should not be removed. The virtual elemental wires 1' at the positions inside the outer peripheral portion should not be removed while unremoved virtual elemental wires 1' are left in the outer peripheral portion of the virtual cross-section. To be specific, the cross-section of the wire conductor 4 does not have a shape such that two or more adjacent circles corresponding to the virtual elemental wires 1' are chipped in the radial direction of the virtual cross-section.

As described above, the number of the elemental wires 1 with which a hexagon arrangement can be achieved by the closest filling is limited to the ones represented by equation (5), and the number of the elemental wires 1 is set to a natural number of four or more, except for the numbers represented by equation (5), in the wire conductor 4 according to the present embodiment. A set number of the elemental wires 1 are concentrically stranded as a whole.

Stranded to have a concentrically stranded structure to constitute the wire conductor 4 as described above, the plurality of elemental wires 1 is brought into the state of being disposed closely to one another. In addition, since the elemental wires 1 can be tightly stranded, the stranded structure is hard to loosen in the wire conductor 4. In particular, the elemental wires 1 can be easily prevented from becoming unsteady in the outer peripheral portion of the wire conductor 4. As a result thereof, the wire conductor 4 having a reduced outer diameter can be obtained while a required conductor cross-sectional area can be secured, which can increase the maximum diameter cross-sectional area ratio and the average diameter cross-sectional area ratio. In addition, variation in the outer diameter of the wire conductor 4 can be suppressed small.

When a hexagon arrangement cannot be achieved, it is preferable that the maximum diameter cross-sectional area ratio of the wire conductor 4 should be, for example, 0.62 or higher by adopting the concentrically stranded structure. The maximum diameter cross-sectional area ratio is more preferably 0.63 or higher, and is especially more preferably 0.66 and higher. In addition, it is preferable that the average diameter cross-sectional area ratio should be 0.73 or higher. The average diameter cross-sectional area ratio is more preferably 0.75 or higher, and is especially more preferably 0.76 or higher. Also in the wire conductor 4 according to the present embodiment, the obtained strand may be compression molded in the radial direction, whereby further diameter reduction of the wire conductor 4 can be achieved. However, it is preferable to achieve the above-described maximum diameter cross-sectional area ratio or average diameter cross-sectional area ratio without carrying out compression molding.

In particular, doing high-accuracy arrangement of the elemental wires 1 in the concentrically stranded structure can improve the diameter reduction effect. For example, in the maximum diameter cross-sectional area ratio, the average diameter cross-sectional area ratio, and the inner perimeter conductor ratio, it is possible to achieve a large value including a manufacturing error of the elemental wires 1, as a numerical value geometrically calculated from a figure obtained by concentrically circumscribing all the elemental wires 1 having a circular shape in cross-section.

In a conventional general wire conductor including elemental wires stranded as a whole, when the elemental wires can achieve a hexagon arrangement by closest filling of the elemental wires as shown in FIG. 4(B), in other words, when the number of the elemental wires can be represented by the above-described equation (5), the concentrically stranded structure is often adopted. However, when the elemental wires cannot achieve such a hexagon arrangement by closest filling of the elemental wires, the assembly stranded structure has generally been adopted conventionally.

If the wire conductor 4 has an assembly stranded structure instead of a concentrically stranded structure, it is difficult to reduce the outer diameter of the wire conductor 4. In the assembly stranded structure, all of the elemental wires 1 are stranded as a whole in the same direction. As shown FIG. 3(A), in the case of the assembly stranded structure, the plurality of elemental wires 1 is arranged at random. In this case, gaps are likely to be formed among the elemental wires 1, and thus the elemental wires 1 in the wire conductor 4 are arranged less closely. In addition, the stranded structure of the elemental wires 1 is likely to loosen. As a result thereof, the outer diameter of the wire conductor 4 is likely to be large. In the case of the assembly stranded structure, the cross-sectional area ratios are likely to be small; for example, the maximum diameter cross-sectional area ratio is lower than 0.62, and the average diameter cross-sectional area ratio is lower than 0.73.

In manufacturing the wire conductor 4 according to the present embodiment, the annealed-state stranding method, in which stranding is carried out after the annealing treatment, may be adopted, or the hard-state stranding method, in which the annealing treatment is carried out after stranding, may be adopted. From the viewpoint of reducing nicks to be made on the surface, the hard-state stranding method is preferably adopted.

Also in the wire conductor 4 according to the present embodiment, the kind of an aluminum alloy of which the elemental wires 1 are made is not particularly designated. It is preferable to use aluminum alloys of 1000 series including pure aluminum alloys or aluminum alloys of 3000 series from the viewpoint that the elemental wires 1 can be stranded closely.

Also the wire conductor 4 according to the present embodiment is formed into an insulated wire 20 by covering its outer peripheral surface with an insulation cover 2, and by suppressing the outer diameter of the wire conductor 4 small, the outer diameter of the entire insulated wire 20 can be suppressed small. Alternatively, in a case where the upper limit value of the outer diameter of the insulated wire 20 is predetermined, the insulation cover 2 can be increased in thickness while the outer diameter of the entire insulated wire 20 is confined within the range. The insulated wire 20 can be also used in the form of a wiring harness.

Also in the present embodiment, the specific dimension of the wire conductor 4 is not particularly designated. However, a larger number of the elemental wires 1 constituting the wire conductor 4 increase the cost and efforts that are required in order that the elemental wires 1 can be stranded as a whole with a high degree of accuracy to reduce the wire conductor in diameter. The wire conductor 4 having a smaller outer diameter includes less elemental wires 1 constituting the wire conductor 4, which can suppress an increase in cost and efforts that is caused by the wholly stranded structure. Basically, the wire conductor 4 adopts, when having a nominal cross-sectional area smaller than 8 sq (a conductor cross-sectional area: 7.882 $mm^2$) stipulated in JASO D603, a wholly stranded structure, not a slave stranding-master stranded structure, and thus it is preferable to adopt the wire conductor 4 according to the present embodiment within the range of a nominal cross-sectional area smaller than 8 sq. It is more preferable to adopt the wire conductor 4 according to the present embodiment within the range of a nominal cross-sectional area 5 sq (a conductor cross-sectional area: 4.665 $mm^2$) or smaller.

In addition, from the viewpoint of achieving the wholly stranded structure without excessively increasing the cost and efforts as described above, the number of the elemental wires 1 constituting the wire conductor 4 is preferably less than 100, and is more preferably less than 61. The number of 61 defines a number that allows a hexagon arrangement represented by equation (5). Meanwhile, from the viewpoint of obtaining a greater diameter reduction effect compared with that obtained by the assembly stranded structure, the number of the elemental wires 1 is preferably 38 or more, and is more preferably 62 or more. A larger number of elemental wires 1 constituting the wire conductor 4 could have more room for being increased in diameter, so that the effect to attain diameter reduction is increased by adopting the concentrically stranded structure, not the assembly stranded structure. In addition, diameter reduction evaluated by the amount of the maximum diameter cross-sectional area ratio is actually achieved with ease.

The outer diameter of each elemental wire 1 to be used is not particularly designated either; however, similarly to the above-described first embodiment, the elemental wires 1 preferably have an outer diameter of 0.5 mm or smaller, and more preferably 0.32 mm or smaller.

In the wire conductor 4 according to the present embodiment, as a specific diameter reduction effect, for example, when the elemental wires 1 have an outer diameter of 0.32 mm and a nominal cross-sectional area of 5 sq, the outer diameter of the wire conductor 4 can be made smaller than 3.10 mm and further can be made 3.00 mm or smaller at the maximum. The outer diameter of the wire conductor 4 can be made smaller than 2.85 mm and further can be made 2.80 mm or smaller on average, and can be made smaller than 2.65 mm and further can be made 2.63 mm or smaller at the minimum. In addition, when the outer diameter of the entire insulated wire 20 is made 3.65 mm or smaller at the maximum and 3.60 mm or smaller on average in this case, the insulation cover 2 can have a thickness (on average) of 0.38 mm or larger, and further can have a thickness of 0.45 mm or larger.

In the present embodiment, the concentrically stranded structure is adopted as a preferable stranded structure achieving diameter reduction of the wire conductor 4 when the elemental wires 1 cannot achieve a hexagon arrangement by closest filling of the elemental wires 1. However, the possible arrangement and the number of the elemental wires 1 are not limited to this case, and the wire conductor 4 including the elemental wires 1 made of aluminum or an aluminum alloy and having the wholly stranded structure can have a diameter reduction effect by adopting the concentrically stranded structure, not the assembly stranding structure.

EXAMPLE

Hereinafter, descriptions of examples of the present invention will be provided.

[Preparation of Samples]

Each conductive wire having a predetermined conductor cross-sectional area was prepared by stranding a plurality of elemental wires made of an aluminum alloy (SR-16 material: containing 1.2 or lower mass % of Fe and 0.5 or lower mass % of Mg). Table 1 shows stranded structures, conductor cross-sectional areas, and elemental wire configurations (the outer diameters of elemental wires [mm]/the numbers of elemental wires, the outer diameters of elemental wires [mm]/the numbers of elemental wires in slave strands/the numbers of slave strands). Here, the conductive wires indicated as having a "Concentrically stranding structure" or an "Assembly stranded structure" in the columns of stranded structures were subjected to an annealing treatment under the conditions of 350° C.×three hours after stranding. On the other hand, the conductive wires indicated as having an "Annealed-state stranded structure" and a "Hard-state stranded structure" in the columns of stranded structures were subjected to an annealing treatment under the conditions of 350° C.×three hours respectively before and after stranding. In addition, the slave-stranded structure by assembly stranding was adopted in both cases of the "Annealed-state stranded structure" and the "Hard-state stranded structure". Any of the wire conductors were not subjected to an aging treatment or compression molding. Further, PVC insulation covers were formed on the outer peripheral surfaces of the obtained wire conductors by extrusion molding, and by subjecting the wire conductors to crosslinking, insulated wires were obtained. The thicknesses of the obtained insulation covers (insulation thicknesses) are indicated in Table 1.

[Evaluation Method]

The wire conductors and insulated wires according to the examples and comparative examples were measured for conductor outer diameters, insulation thicknesses, and outer diameters of the insulated wires (finished outer diameters). The number of the samples for each of the examples and comparative examples was set to N=30. However, only in the evaluation of the finished outer diameters of the comparative examples, the number was set to N=3. In Table 1, minimum values and maximum values in addition to average values are indicated for each of the dimensions. Here, the dimensions were obtained by carrying out measurements of each sample in cross-section at various positions, and a plurality of values thus obtained for each sample was tallied for all the samples to obtain their overall averages while maximum values and minimum values among them were recorded. Moreover, the cross-sectional area ratios were calculated based on the maximum diameters and average diameters of the conductors, which were obtained from the obtained conductor cross-sectional areas and the average values of the conductor outer diameters, (maximum diameter cross-sectional area ratios and average diameter cross-sectional area ratios), standard deviations of the conductor outer diameters were calculated, and the process capability indexes (Cpk) were calculated for the insulation thicknesses.

[Result]

Table 1 below shows the results of the evaluations in addition to the configurations of the wire conductors. In addition, FIG. 5 are photographs of the cross-sections of the insulated wires according to the examples and comparative examples. The cross-sections were prepared by embedding each insulated wire in an epoxy resin and cutting them.

Example 2 and Comparative Example 2, which have the same conductor cross-sectional area, and between Example 3 and Comparative Example 3, which have the same conductor cross-sectional area, the conductor outer diameters are smaller all at the average values, the minimum values, and the maximum values in the examples. Further as a result thereof, the cross-sectional area ratios based on the average values and the maximum diameters of the conductor outer diameters are higher in the examples.

Also the standard deviations of the conductor outer diameters are smaller in the examples. In addition, while the finished outer diameters of the insulated wires are almost the same in each pair of examples and comparative examples, the insulation covers can have larger thicknesses in the examples. Accordingly, the process capability indexes (Cpk) in forming the insulation covers are higher.

TABLE 1

| | | Example 1 | Comparative Example 1 | Example 2 | Comparative Example 2 | Example 3 | Comparative Example 3 |
|---|---|---|---|---|---|---|---|
| Wire conductor configuration | Stranding structure | Concentrically stranding structure | Assembly stranding structure | Annealed-state stranding structure | Hard-state stranding structure | Annealed-state stranding structure | Hard-state stranding structure |
| | Nominal dimension | 5 sq | | 10 sq | | 20 sq | |
| | Elemental wire configuration | 58/0.32 | | 7/18/0.32 | | 19/13/0.32 | |
| | Conductor cross-sectional area | 4.665 $mm^2$ | | 10.13 $mm^2$ | | 19.86 $mm^2$ | |
| Conductor outer diameter [mm] | Average | 2.79 | 2.86 | 4.20 | 4.30 | 5.80 | 6.04 |
| | Minimum | 2.63 | 2.64 | 3.91 | 4.03 | 5.33 | 5.53 |
| | Maximum | 2.99 | 3.12 | 4.49 | 4.57 | 6.18 | 6.51 |
| | Standard deviation | 0.08 | 0.16 | 0.16 | 0.20 | 0.17 | 0.20 |
| Insulation thickness [mm] | Average | 0.45 | 0.37 | 0.75 | 0.64 | 0.86 | 0.72 |
| | Minimum | 0.33 | 0.26 | 0.54 | 0.44 | 0.64 | 0.52 |
| | Maximum | 0.60 | 0.54 | 1.05 | 0.83 | 1.02 | 0.99 |
| | Cpk | 0.65 | −0.03 | 1.25 | 0.05 | 1.54 | 0.45 |
| Finished outer diameter [mm] | Average | 3.59 | 3.58 | 5.68 | 5.64 | 7.60 | 7.63 |
| | Minimum | 3.52 | 3.53 | 5.52 | 5.54 | 7.42 | 7.26 |
| | Maximum | 3.65 | 3.63 | 5.80 | 5.72 | 7.76 | 7.91 |
| Cross-sectional area rate | Average diameter based | 0.763 | 0.726 | 0.731 | 0.698 | 0.752 | 0.693 |
| | Maximum diameter based | 0.664 | 0.610 | 0.640 | 0.618 | 0.662 | 0.597 |

In the photographs of FIGS. 5A-5F, it is recognized that the concentrically stranded structure according to Example 1 has an arrangement of the elemental wire such that three virtual elemental wires are removed from the outer peripheral portion of the virtual cross-section of the hexagon arrangement. In addition, in respective comparisons between Example 1 and Comparative Example 1, Example 2 and Comparative Example 2, and Example 3 and Comparative Example 3, it is recognized that the ratio of the area occupied by the elemental wires inside the region surrounded by the insulation cover is higher while the ratio of the gaps observed to be dark is lower in each of the examples. In other words, the elemental wires are arranged very closely by adopting the concentrically stranded structure as in Example 1, not the assembly stranded structure as in Comparative Example 1, and by adopting the annealed-state stranded structure as in Examples 2 and 3, not the hard-state stranded structure as in Comparative Examples 2 and 3.

As a result thereof, in Table 1, in respective comparisons between Example 1 and Comparative Example 1, which have the same conductor cross-sectional area, between While the embodiments of the present invention have been described in detail, the present invention is not limited to the above-described embodiments, and various modifications can be made without departing from the gist of the present invention.

DESCRIPTION OF REFERENCE NUMERALS AND SIGNS

1 Elemental wire
1' Virtual elemental wire
2 Insulation cover
3, 4 Wire conductor
3*a* Slave strand
10, 20 Insulated wire
H Circumscribing figure

The invention claimed is:

1. A wire conductor comprising:

a plurality of elemental wires made of aluminum or an aluminum alloy and having a same outer diameter, the elemental wires stranded with each other, all of the elemental wires in the conductor concentrically stranded as a whole, the elemental wires having an arrangement, in cross-section intersecting an axial direction of the wire conductor, in which one or a plurality of virtual elemental wires are removed from an outer peripheral portion of a virtual cross-section represented by a maximum number of virtual elemental wires accommodated in a circumscribing figure approximated by a regular hexagon, the virtual elemental wires having a same diameter as the elemental wires, and virtual elemental wires adjacent to each other are not removed.

2. The wire conductor according to claim 1, wherein a maximum diameter cross-sectional area ratio is 0.62 or higher, the maximum diameter cross-sectional area ratio being a value calculated by dividing a cross-sectional area of the wire conductor by an area of a circle having a diameter equal to a maximum value of an outer diameter of the wire conductor, and the wire conductor is not compression molded.

3. The wire conductor according to claim 2, wherein the maximum diameter cross-sectional area ratio is 0.66 or more.

4. The wire conductor according to claim 1, wherein an average diameter cross-sectional area ratio is 0.73 or higher, the average diameter cross-sectional area ratio being a value calculated by dividing a cross-sectional area of the wire conductor by an area of a circle having a diameter equal to an average value of an outer diameter of the wire conductor, and the wire conductor is not compression molded.

5. The wire conductor according to claim 4, wherein the average diameter cross-sectional area ratio is 0.76 or higher.

6. The wire conductor according to claim 1, wherein the outer diameter of each of the elemental wires is 0.32 mm, a nominal cross-sectional area of the wire conductor is 5 sq, and a maximum value of the outer diameter of the wire conductor is smaller than 3.10 mm.

7. The wire conductor according to claim 1, wherein the outer diameter of each of the elemental wires is 0.32 mm, a nominal cross-sectional area of the wire conductor is 5 sq, and an average value of the outer diameter of the wire conductor is smaller than 2.85 mm.

8. The wire conductor according to claim 1, wherein all of the elemental wires in the conductor concentrically stranded as a whole, a number of the elemental wires constituting the wire conductor being a natural number of four or more, except for $3n(n+1)+1$, where n is a natural number of one or more.

9. The wire conductor according to claim 1, wherein one of the virtual element wires at a corner position of the circumscribing figure is removed, and one of the virtual element wires at an edge position between corner positions is not removed.

10. A wire conductor comprising:

a plurality of elemental wires made of aluminum or an aluminum alloy and having a same outer diameter, the elemental wires stranded with each other, all of the elemental wires in the conductor concentrically stranded as a whole, a number of the elemental wires constituting the wire conductor being a natural number of four or more, except for $3n(n+1)+1$, where n is a natural number of one or more, wherein the outer diameter of each of the elemental wires is 0.32 mm, a nominal cross-sectional area of the wire conductor is 5 sq, and a maximum value of the outer diameter of the wire conductor is smaller than 3.10 mm.

11. A wire conductor comprising:

a plurality of slave strands, each of the slave strands being a strand of a plurality of elemental wires made of aluminum or an aluminum alloy, wherein a maximum diameter cross-sectional area ratio is 0.63 or larger, the maximum diameter cross-sectional area ratio being a value calculated by dividing a cross-sectional area of the wire conductor by an area of a circle having a diameter equal to a maximum value of an outer diameter of the wire conductor, and the wire conductor is not compression molded.

12. The wire conductor according to claim 11, wherein an average diameter cross-sectional area ratio is 0.71 or higher, the average diameter cross-sectional area ratio being a value calculated by dividing the cross-sectional area of the wire conductor by an area of a circle having a diameter equal to an average value of an outer diameter of the wire conductor.

13. The wire conductor according to claim 11, wherein an outer diameter of each of the elemental wires is 0.32 mm, a nominal cross-sectional area of the wire conductor is 10 sq, and a maximum value of the outer diameter of the wire conductor is smaller than 4.6 mm.

14. The wire conductor according to claim 11, wherein an outer diameter of each of the elemental wires is 0.32 mm, the nominal cross-sectional area of the wire conductor is 10 sq, and an average value of the outer diameter of the wire conductor is smaller than 4.3 mm.

15. The wire conductor according to claim 11, wherein an outer diameter of each of the elemental wires is 0.32 mm, a nominal cross-sectional area of the wire conductor is 20 sq, and a maximum value of the outer diameter of the wire conductor is smaller than 6.5 mm.

16. The wire conductor according to claim 11, wherein an outer diameter of each of the elemental wires is 0.32 mm, the nominal cross-sectional area of the wire conductor is 20 sq, and an average value of the outer diameter of the wire conductor is smaller than 6.0 mm.

* * * * *